US005445927A

United States Patent [19]

Florens et al.

[11] Patent Number: 5,445,927

[45] Date of Patent: Aug. 29, 1995

[54] SILVER HALIDE PHOTOGRAPHIC INDUSTRIAL RADIOGRAPHY SUITABLE FOR VARIOUS PROCESSING APPLICATIONS

[75] Inventors: Raymond Florens, Edegem; Pieter Perdieus, O.L.V.Waver, both of Belgium

[73] Assignee: Agfa-Gevaert, N.V., Mortsel, Belgium

[21] Appl. No.: 227,629

[22] Filed: Apr. 14, 1994

[30] Foreign Application Priority Data

Apr. 27, 1993 [EP] European Pat. Off. ..... 93201223

[51] Int. Cl.[6] ..... G03C 1/46

[52] U.S. Cl. ..... 430/502; 430/139; 430/571; 430/967; 430/567; 430/621

[58] Field of Search ..... 430/502, 139, 571, 967, 430/567, 621

[56] References Cited

U.S. PATENT DOCUMENTS 3,140,179 7/1964 Russell ..... 430/506
3,152,907 10/1964 Godowsky et al. ..... 430/545
3,841,872 10/1974 Burness et al. ..... 430/415
4,414,304 11/1983 Dickerson ..... 430/502
5,112,731 5/1992 Miyasaki ..... 430/567

FOREIGN PATENT DOCUMENTS 0538947 4/1993 European Pat. Off. .

*Primary Examiner*—Thomas R. Neville
*Attorney, Agent, or Firm*—Breiner & Breiner

[57] ABSTRACT

A photographic silver halide material for industrial radiography comprises a film support and on one or both sides thereof a silver halide emulsion rich in silver chloride and a silver halide emulsion rich in silver bromide either in admixture in the same layer or in contiguous layers. The ratio by weight of colloid binder, e.g. gelatin, to silver halide (expressed as silver nitrate) is from 3:10 to 6:10 and the amount of silver halide corresponds to from 6 g to 20 g of silver nitrate per square meter and per side. The material has been forehardened to an extent such that when it is immersed in demineralised water of 25° C. for 3 minutes there is absorbed less than 2.5 g of water per gram of binder. The material can be processed within a total processing time of less than 5 minutes with a developer and fixer being substantially free from hardening agents and the fixer being substantially free from ammonium ions.

7 Claims, No Drawings

SILVER HALIDE PHOTOGRAPHIC INDUSTRIAL RADIOGRAPHY SUITABLE FOR VARIOUS PROCESSING APPLICATIONS

FIELD OF THE INVENTION

The present invention relates to photographic materials for industrial radiography for use in various processing applications.

BACKGROUND OF THE INVENTION

In the field of industrial radiography, especially for non-destructive testing applications, film materials showing excellent image quality after processing in hardener containing developer and/or fixer solutions are well-known. The said materials are characterised by the presence of high coated amounts of silver bromoiodide emulsion crystals in the range of 6 to 20 grams, expressed as the equivalent amount of silver nitrate, per square meter and per side. Long processing times, varying between 5 and 15 minutes, are time consuming and shorter processing times are not available without drying problems (e.g. sticking) and degeneration of image quality (e.g. deposit on the film due to "pi-line" defects) and sensitometry (e.g. too low a contrast and/or a speed).

In the field of industrial radiography, and especially for non-destructive testing applications, any time saving measure is welcome: the tendency is to reduce the processing time to a maximum of 5 minutes and more preferably to about 2.5 minutes. In order to achieve high film speed, which is an indispensible asset especially for direct-X-ray applications, efficient absorption of the exposure radiation is a prime condition. It has been shown empirically that for X-rays the mass absorption coefficient is proportional to a power of the atomic number Z as has been described in the "Encyclopaedic Dictionary of Physics" vol. 7, p. 787, eq. 10, Ed. J. Thewlis, Pergamom Press, Oxford 1957. This strongly disfavours e.g. the use of chloride ($Z=17$) compared to bromide ($Z=35$) or iodide ($Z=54$). Otherwise a cubic habit is favoured because of the volume effect of the silver halide crystal to get good absorption properties when exposing said crystals.

Nevertheless it has been shown in EP-A No. 91202761, filed Oct. 24, 1991 that the object to get rapid processable industrial radiographic films can be accomplished by a photographic silver halide material comprising a film support and on one or both sides thereof at least one silver halide emulsion layer which is characterised in that each silver halide emulsion layer comprises as silver halide silver chloride or silver chlorobromide the amounts of bromide being at most 25 mole %, in that it has a gelatin to silver halide (expressed as silver nitrate) ratio by weight from 3:10 to 6:10 and an amount of silver halide corresponding to from 5 g to 15 g of silver per sq. m. and in that the photographic material has been fore-hardened to an extent such that when it is immersed in demineralised water of 25° C. for 3 minutes there is absorbed less than 2.5 g of water per gram of gelatin.

However as it is nowadays required for the said industrial radiographic films to be processable in different processing cycles within a total processing time in the range between 2.5 and 8 minutes, the problem arises that the silver chloride and/or silver chlorobromide emulsions used in the said EP-Application may show too high, irreproducible fog levels so that the compatibility in different processing cycles is not guaranteed.

Due to the solubility of crystals rich in silver chloride and to the large amount of said crystals in the coated layers of industrial radiographic material silver sludge appears. Sulphite rich developers further reinforce the amount of silver sludge. As a result, so-called "pi-line" defects may occur, as a result of unwanted deposit of silver sludge on the rollers in the developer racks of automatic processors that is carried over to the film at recurrent distances. Consequently an enhanced maintenance frequency is necessary for the processor resulting in an enhanced cost and loss of time.

OBJECTS OF THE INVENTION

A first object of the present invention is to provide a silver halide photographic material for industrial radiography which provides a good compatibility in particular regarding low fog levels in different processing cycles.

A second object of the invention is to provide an industrial photographic material giving less silver sludge formation in the processing solutions and related therewith a reduced "pi-line" defect after processing of the said material and requiring less maintenance for the processor.

Other objects will become apparent from the description hereafter.

SUMMARY OF THE INVENTION

The above objects are accomplished by a photographic silver halide material for industrial radiography comprising a film support and on one or both sides thereof at least one emulsion layer containing silver chloride and at least one non-sensitive protective antistress coating characterised in that said at least one emulsion layer containing silver chloride further comprises at least one silver bromide and/or silver bromoiodide emulsion mixed with the said emulsion(s) containing chloride and/or has contiguous thereto at least one adjacent layer comprising silver bromide and/or bromoiodide emulsion crystals, the total amount by weight of the non-chloride containing emulsions, expressed as silver nitrate, corresponding to less than 75% of the totally coated amount of silver halide and in that the total ratio by weight of colloidal binder to silver halide (expressed as silver nitrate) of the silver halide emulsion layer(s) is from 3:10 to 6:10, the total amount of silver halide corresponds to from 6 g to 20 g of silver nitrate per square meter and per side and that the material has been forehardened to an extent such that when it is immersed in demineralised water of 25° C. for 3 minutes there is absorbed less than 2.5 g of water per gram of colloid binder.

By emulsion layer(s) containing chloride is understood an emulsion of silver chloride, silver chloroiodide, silver chlorobromide and silver chlorobromoiodide or a mixture of at least two thereof. By non-chloride containing emulsions is understood an emulsion of silver halide crystals not containing chloride, i.e. crystals of silver bromide and silver bromoiodide.

DETAILED DESCRIPTION OF THE PRESENT INVENTION

In accordance with the present invention the photographic silver halide material for industrial radiography comprises a film support and on one or both sides thereof at least one silver halide emulsion layer comprising a mixture of a silver chloride, silver chloroiodide, silver chlorobromide or silver chlorobromoiodide emulsion and a silver bromide or silver bromoiodide emulsion and/or on one or both sides thereof at least one silver halide emulsion layer comprising a silver chloride, silver chloroiodide, chlorobromide or silver chlorobromoiodide emulsion and having contiguous thereto an adjacent silver bromide or bromoiodide emulsion layer. The said silver bromide or bromoiodide is present in an amount by weight, expressed as silver nitrate, corresponding to less than 75% of the totally coated amount of silver halide. Said totally coated amount of silver halide, expressed as the equivalent amount of silver nitrate, is from 6 g to 20 g per square meter and per side of the support.

In the case of contiguous layers the silver bromide or silver bromoiodide emulsion layer can be present as an adjacent layer, farther from the support than the silver chloride containing emulsion layer(s), between two silver chloride containing emulsion layers or between a silver chloride containing layer and the support. The said support can be coated with a subbing layer.

In another embodiment the silver bromide and/or silver bromoiodide emulsion crystals can be present in one or in at least one of the silver chloride containing emulsion layer(s) with or without the presence of at least one adjacent silver bromide and/or silver bromoiodide containing light-sensitive layer, wherein the said adjacent layer(s) can be present as described hereinbefore.

In all these layer arrangements, the total amount of silver bromide and silver bromoiodide should be less than 75% of the total amount of silver halide coated, said amount of silver halide being expressed by weight as the equivalent amount of silver nitrate.

In a preferred embodiment the photographic material according to this invention is a double side coated radiographic material having a silver halide emulsion layer on both sides of the support, wherein the silver bromide and/or silver bromoiodide emulsion crystals are in admixture with the silver chloride emulsion crystals.

In another embodiment the photographic material according to this invention has one silver bromide and/or silver bromoiodide containing emulsion layer adjacent to the said silver chloride containing layer, wherein the said adjacent layer is situated farthest from the support at both sides. Silver bromide and/or silver bromoiodide emulsion crystals can be further present in the chloride containing layer.

The emulsions containing chloride (e.g. silver chloride, chlorobromide, chlorobromoiodide and chloroiodide emulsions) present as host emulsion crystals in accordance with this invention are prepared according to the conventional preparation techniques as well as the silver bromide or silver bromoiodide emulsions.

The emulsions rich in chloride preferably comprise at least 90 mole % of chloride ions and not more than 1 mole % of iodide ions.

The silver bromoiodide emulsions, mixed together with or present in an adjacent layer contiguous to the silver chloride containing layer(s) preferably comprise not more than 2 mole % of iodide ions.

Preferably all silver halide crystals present have a regular crystal habit and more preferably the said habit is cubic, as silver halide crystals having a cubic habit are known to have good development characteristics with respect to high sensitivity. The parameter determining whether cubic or octahedral crystals are formed during the precipitation stage of the photographic emulsion making is the pAg of the solution.

During precipitation of the silver halide crystals according to this invention the pAg of the solution may be regulated by any of the means known in the art of emulsion making, such as the electronic control apparatus and method disclosed in U.S. Pat. No. 3,821,002.

From the article "Der Einflu$\beta$ der Wachstumsbedingungen auf die Kristalltracht der Silberhalogenide" (the influence of Growth Conditions on the Crystalline Behaviour of Silver halides) von E. Moisar and E. Klein, Bunsengesellschaft für physikalische Chemie, Berichte 67 949–957 (1963) No 9.10., it is known that on allowing tetradecahedral crystals of a homodisperse silver bromide emulsion to grow by controlled addition of solutions of silver nitrate and potassium bromide, crystals of cubic form are obtained under conditions of low excess bromide concentration in the solution phase. This can be applied for the preparation of monodisperse cubic silver bromide or silver bromoiodide emulsion crystals for use according to this invention. Monodispersed emulsions in contrast to heterodispersed emulsions have been characterized in the art as emulsions of which at least 95% by weight or number of the grains have a diameter which is within about 40%, preferably within about 30% of the mean grain diameter and more preferably within about 10% to 20%.

In order to get such homogeneous silver bromide or silver bromoiodide crystal distribution after precipitation it is recommended that before the start and during the different stages of the precipitation the pAg is maintained between 105 and 85 mV during the nucleation step and preferably between 90 and 65 mV during the growth phase and that pH is maintained between 5.2 and 5.8 preferably between 5.6 and 5.8. Although the precipitation in connection with the present invention can be principally performed by one double jet step it is preferred to perform a sequence of a nucleation step and at least one growth step. Of the total silver halide precipitated preferably 0.5% to 5.0% is added during said nucleation step which consists preferably of an approximately equimolecular addition of silver ions and bromide and/or iodide ions. The rest of the silver, the bromide and/or the mixtures of bromide and iodide ions is added during one or more consecutive double jet growth steps.

For the emulsions containing silver chloride used in accordance with the present invention the double jet technique is preferred during precipitation. Silver and chloride salts or mixtures of chloride and bromide and/or iodide salts are added during one or more consecutive double jet growth steps. The different steps of the precipitation can be alternated by physical ripening steps. During the growth step(s) an increasing flow rate of silver and halide solutions is preferably established, e.g. a linearly increasing flow rate. Typically the flow rate at the end is about 3 to 5 times greater then at the start of the growth step. These flow rates can be monitored by e.g. magnetic valves.

There can be a homogeneous distribution of the silver halide used over the whole volume of the silver halide crystals, for which the composition of the halide solution remains unchanged during the whole precipitation. However, a core-shell or multistructure emulsion can be used wherefore the composition of the halide solutions is varied during the growth stage. The moment at which this change has to take place depends on the desired thickness of the core and the shell and on the amounts and the ratio of chloride to bromide to iodide ions that have to be built into the crystals. For the silver bromoiodide emulsions having a core-shell structure preferably the core is more iodide rich than the shell. This means that preferably the shell contains less than 2 mole % of iodide ions and more preferably less than 1 mole %.

For the silver chlorobromoiodide or chloroiodide emulsions having a core-shell structure the shell is preferably more rich in chloride than the core. Preferably the average iodide content over the whole crystal volume is less than 1 mole %. If iodide ions are present at the crystal surface of the core-shell crystal an amount of less than 0.5 mole % of iodide ions is preferable at the said surface.

For the preparation of the emulsions rich in silver chloride or rich in silver bromide used in accordance with the present invention gelatin, a gelatin derivative or some other colloid binder may be used. Especially conventional lime treated or acid treated gelatin are preferred. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). Before and during the formation of the silver halide grains the gelatin concentration is kept from about 0.05% to 5.0% by weight in the dispersion medium. Additional gelatin is added in a later stage of the emulsion preparation, e.g. after washing, to establish optimal coating conditions and/or to establish the required thickness of the coated emulsion layer. The gelatin to silver halide ratio then ranges from 0.3 to 0.6. Alternatively colloidal silica may be used as a protective colloid as has been described in EP Application 392 092.

The silver halide grains used in accordance with the present invention preferably have an average grain size from 0.15 to 1.0 μm. To obtain a reproducible crystal size especially the flow rate and concentration of the solutions, the temperature and pAg have to be adjusted very carefully. Particle size of silver halide grains can be determined using conventional techniques e.g. as described by Trivelli and M. Smith, The Photographic Journal, vol. 69, 1939, p. 330–338, Loveland "ASTM symposium on light microscopy" 1953, p. 94–122 and Mees and James "The Theory of the photographic process" (1977), Chapter II.

After completion of the precipitation a wash technique in order to remove the excess of soluble salts is applied at a pH value which can vary during washing but remains comprised between 3.7 and 3.3 making use of a flocculating agent like polystyrene sulphonic acid. Normally the emulsion is washed by diafiltration by means of a semipermeable membrane, also called ultrafiltration, so that it is not necessary to use polymeric flocculating agents that may disturb the coating composition stability before, during or after the coating procedure. Such procedures are disclosed e.g. in Research Disclosure Vol. 102, Oct. 1972, Item 10208, Research Disclosure Vol. 131, March, Item 13122 and Mignot U.S. Pat. No. 4,334,012. Preferably, at the start of the ultrafiltration, there is no pH and pAg adjustment; pH and pAg are the same as at the end of the preceding precipitation without any adjustment stage. Coagulation techniques using acid-coagulable gelatin derivatives can also be used and have been described e.g. in U.S. Pat. Nos. 2,614,928, 2,614,929 and 2,728,662. The acid-coagulable gelatin derivatives are reaction products of gelatin with organic carboxylic or sulphonic acid chlorides, carboxylic acid anhydrides, aromatic isocyanates or 1,4-diketones. The use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acid-coagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the United States Patent Specifications referred to above. Particularly suitable are phthaloyl gelatin and N-phenylcarbamoyl gelatin.

The coagulum formed may be removed from the liquid by any suitable means, for example the supernatant liquid is decanted or removed by means of a siphon, whereupon the coagulum is washed out once or several times. When precipitation occurred in silica medium, coagulation is effected by addition of certain polymers capable of forming hydrogen bridges with silica, in an amount sufficient to form coagulable aggregates with the silica particles as has been described in EP Application 517 961.

Instead or in addition to normal gelatin, which is preferably used, other known photographic hydrophilic colloids can also be used for redispersion e.g. a gelatin derivative as referred to above, albumin, agar-agar, sodium alginate, hydrolysed cellulose esters, polyvinyl alcohol, hydrophilic polyvinyl copolymers, colloidal silica etc.

The emulsions present in the industrial radiographic materials of the present invention are separately chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripenera or by means of reductors e.g. tin compounds as described in GB 789,823, amines, hydrazinc derivatives, formamidine-sulphinic acids etc.

The silver halide emulsion layer(s) in accordance with the present invention or the non-light-sensitive layers, like e.g. the protective layers, may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion at any stage of the emulsion preparation. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazolinethione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

The gelatin binder of the photographic elements according to the present invention can be hardened with appropriate hardening agents such as those of the epoxide type, those of the ethylenimine type, those of the vinylsulfone type e.g. 1,3-vinylsulphonyl-2-propanol, aldehydes e.g. formaldehyde, glyoxal, and glutaric aldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP Application 408 143. Especially preferred hardeners according to the present invention are di-(vinyl-sulphonyl)-methane and ethylene di-(vinyl-sulphone). Hardening is to such an extent that when the photographic material is immersed in demineralized water of 25° C. at most 2.5 g of water is absorbed per gram of colloid binder in 3 minutes.

The photographic elements under consideration may further comprise various kinds of surface-active agents in the photographic emulsion layer and/or in at least one other hydrophilic colloid layer. Preferred surface-active coating agents are compounds containing perfluorinated alkyl groups.

The photographic elements may further comprise various other additives such as e.g. compounds improving the dimensional stability of the photographic element, UV-absorbers, spacing agents and plasticizers.

The photographic material according to the present invention is preferably a double side coated material i.e. having on both sides of the film support emulsion layers. Both emulsion layers are overcoated with at least one antistress layer.

In a special embodiment the silver halide layer(s) used according to this invention may comprise at least one spectral sensitizer, wherein the said spectral sensitizer can make the silver halide crystals sensitive to the wavelength of radiation emitted by intensifying screens, capturing high energy particle radiation. If present the said intensifying screens are preferably placed in contact at both sides of the industrial silver halide photographic material.

The support of the photographic material in accordance with the present invention may be a transparent resin, preferably a blue coloured polyester support like polyethylene terephtalate. The thickness of such organic resin film is preferably about 175 μm. The support is provided with a substrate layer at both sides to have good adhesion properties between the emulsion layer and said support.

The photographic material can be image-wise exposed by means of an x-ray radiation source the energy of which, expressed in kV, depends on the specific application. Another typical radiation source is a radioactive $Co^{60}$ source. To reduce the effect of scattering radiation a metal filter, usually a lead filter, can be used in combination with the photographic film.

For processing, preferably an automatically operating apparatus is used provided with a system for automatic replenishment of the processing solutions. Film materials in accordance with this invention may be processed in developer solutions of different compositions as e.g. hydroquinone-1-phenyl-3-pyrazolidinone, 1-phenyl-3-pyrazolidinone-ascorbic acid and ascorbic acid itself. An amount of potassium thiocyanate in the range of 0.1 to 10 g pro liter of the developer solution is recommended to obtain high gradation values. An amount of 25 to 250 mg of potassium iodide pro liter is particularly recommended to obtain a higher speed.

The developer solution according to the invention has to be replenished not only for decrease of the liquid volume due to cross-over into the next processing solution but also for pH-changes due to oxidation of the developer molecules. This can be done on a regular time interval basis or on the basis of the amount of processed film or on a combination of both.

The development step can be followed by a washing step, a fixing solution and another washing or stabilization step.

For film materials comprising silver chloride rich and silver brom(oiod)ide emulsions in accordance with the present invention it is possible to use sodium thiosulphate as a fixing agent, thus avoiding the ecologically undesired ammonium ions normally used.

Finally after the last washing step the photographic material is dried.

In accordance with this invention the exposed forehardened photographic material for industrial radiography is processed in processing solutions, e.g. a developer and/or a fixer, which is(are) substantially free from hardening agents. A total processing time of less than 5 minutes can be attained.

Following the preferred embodiments in accordance with this invention the said silver halide photographic material provides a good compatibility in different processing cycles, especially concerning acceptably low fog levels, gives less silver sludge formation in the processing solutions and related therewith a reduced "pi-line" defect after processing of the said material, less maintenance for the processor and provides a good archivability for the rapidly processed industrial photographic material.

The following examples illustrate the invention without however limiting it thereto.

EXAMPLE 1

Emulsion A

A gelatino silver chlorobromoiodide emulsion comprising 97.6 mole % of chloride, 2 mole % of bromide and 0.4 mole % of iodide was prepared by a double jet technique. The silver halide was precipitated in an aqueous solution of inert gelatin at 55° C., containing methionin as a growth accelerator in an amount of 4 g pro mole of silver nitrate, by the addition of an aqueous solution of silver nitrate and an aqueous solution of chloride and bromide salts in the right mixture ratio to obtain the composition mentioned previously. The silver halide crystals were physically ripened in a conventional way until the desired grain size of 0.32 μm was reached.

At the end of the precipitation step, the emulsion was coagulated by adding polystyrene sulphonic acid acting as a flocculating agent after adjustment of the pH value of the emulsion in the reaction vessel to 3.5 with sulphuric acid. After rapid sedimentation of said silver halide emulsion the supernatant liquid was decanted. To remove the water-soluble salts from said flocculate demineralized water of 11° C. was added under controlled stirring conditions followed by a further sedimentation and decantation. This washing procedure was repeated until the emulsion was sufficiently desalted.

After addition of inert gelatin to a ratio of gelatin to silver halide expressed as silver nitrate in the emulsion of 0.5, the emulsion was peptised and was chemically ripened to an optimal fog-sensitivity relationship at 52° C. Chemical ripening agents, besides gold (in an amount of 0.025 mmole per mole of silver nitrate), were toluene thiosulphonic acid and iodide ions, both being predigestion agents in amounts of 11.5 mg and 11.5 moles pro mole of silver nitrate respectively.

Emulsion B

A gelatino silver iodobromide X-ray emulsion comprising 99 mole % of silver bromide and 1 mole % of silver iodide was prepared in the following way. An aqueous solution containing 22 grams of methionin was added to the reaction vessel containing 1550 ml of a 3% by weight aqueous solution of gelatin at 45° C. Into said reaction vessel a solution of 2000 ml of an aqueous 1.5 molar solution of potassium bromide and a solution of 2000 ml of an aqueous 1.5 molar solution of silver nitrate were introduced at constant rate of 86 ml/min under vigorously stirring conditions. During precipitation the pAg value was adjusted to and maintained at a value corresponding to an E.M.F. of +20 mV as referred to a silver/saturated calomel reference electrode. In this way homogeneous and regular silver halide grains having a crystal diameter of 0.35 μm were obtained.

At the end of the precipitation step, the emulsion was coagulated by adding polystyrene sulphonic acid acting as a flocculating agent after adjustment of the pH value of the emulsion in the reaction vessel to 3.5 with sulphuric acid. After rapid sedimentation of said silver halide emulsion the supernatant liquid was decanted. To remove the water-soluble salts from said flocculate demineralized water of 11° C. was added under controlled stirring conditions followed by a further sedimentation and decantation. This washing procedure was repeated until the emulsion was sufficiently desalted. Thereafter the coagulum was redispersed at 45° C. in water after the addition of a sufficient amount of gelatin to obtain a ratio of gelatin to silver halide expressed as silver nitrate of 0.5. The pH-value was adjusted to 6.5 and pAg to a value of +70 mV as referred to the silver/saturated calomel electrode.

Chemical sensitization of said emulsion was performed by the addition of a sulphur and gold sensitizer and digestion at 50° C. to the point where the highest sensitivity was reached for a still acceptable fog level.

Film 11 (Comparative Sample)

As a comparative example this film was coated with emulsion A at both sides of a blue polyethylene terephtalate support having a thickness of 175 μm, so that per sq. m. and per side an amount of silver halide corresponding to 10.5 g of silver nitrate and 5.25 g of gelatin were present. Before coating stabilizers such as the sodium salt of 7-sulpho-naphto-[2,3-D]-oxazoline-2-thion and 1-phenyl-5-mercaptotetrazole were added to the emulsion. The emulsion layers were covered at both sides with a protective layer of 1.4 grams of gelatin per square meter, which were hardened with 0.134 g of di-(vinyl-sulphonyl)-methane per square meter. This corresponds with an absorption of about 2.3 grams per gram of gelatin when immersed for 3 minutes at 25° C. in demineralised water.

Samples of the said coated and dried film were directly exposed according to ISO 7004 with a 235 kV radiation source with a copper filter of 8 mm thickness. Other samples were first stored for 36 hours at 57° C. and 34% RH (relative humidity) before exposure and processing.

The exposed radiographic film samples were developed, fixed, rinsed and dried in an automatic machine processing cycle of 8 minutes. The samples were run in a Structurix NDT-1 machine marketed by Agfa-Gevaert and developed at 28° C. in the commercially available Agfa-Gevaert NDT-developer G135 followed by a fixation step at 28° C. using Agfa-Gevaerts commercial G335 fixer.

Alternatively the exposed radiographic samples were developed, fixed, rinsed and dried in an automatic machine processing cycle of 2 minutes and 30 seconds. The samples were run in a Structurix NDT-M machine marketed by Agfa-Gevaert and developed at 28° C. in the a developer, followed by fixation at 28° C. in a fixer having the following compositions:

Composition of the concentrated one-part package developer (amounts given in grams/liter) was as follows:

| | |
|---|---|
| water | 500 ml |
| potassium bromide | 5 grams |
| potassium sulphite | 195 grams |
| ethylenediamine tetraacetic acid, tetrasodium salt trihydrate | 8.0 grams |
| hydroquinone | 40.0 grams |
| potassium carbonate | 61.2 grams |
| potassium hydroxyde | 10.57 grams |
| 1-phenyl-3-pyrazolidinone | 1.6 grams |
| potassium thiocyanate | 2.0 grams |
| polyoxyethylene (M.W. 200) | 40 ml |
| Water to make 1 liter. | |

pH adjusted to 10.70 at 25° C. with potassium hydroxide. For initiation of the processing one part of the concentrated developer was mixed with 1 part of water. No starter was added. The pH of the mixture was 10.46 (measured at 25° C.).

The composition of the concentrated one-part package fixer:

| | |
|---|---|
| sodium thiosulphate.$5H_2O$ | 628 grams |
| borax | 36.0 grams |
| sodium sulphite | 40 grams |
| citric acid.$1H_2O$ | 40 grams |
| Water to make 1 liter. | |

pH adjusted to 5.30 at 25° C. with sodium hydroxyde. For initiation of the processing 1 part of the concentrated fixer was mixed with 1 part of water.

The pH of this mixture was 5.50 (measured at 25° C.).

Film 12

Film 12 was prepared in the same way as film 11 with the difference that before coating emulsion A was mixed with emulsion B, in an amount that corresponds to 90% by weight of the total amount of silver halide, expressed as silver nitrate, for emulsion A and 10% for emulsion B. Total amounts of silver nitrate, gelatin and degree of hardening were the same for film 12 as for film 11.

Film 13

Film 13 was coated in the same way as film 12, the only difference being the admixture of emulsion A and emulsion B, in an amount corresponding to 75% by weight of the total amount of silver halide, expressed as silver nitrate for emulsion A and 25% for emulsion B.

Film 14

Film 14 was coated in the same way as film 12, the only difference being the admixture of emulsion A and emulsion B, in an amount corresponding to 50% by weight of the total amount of silver halide, expressed as silver nitrate for emulsion A and 50% for emulsion B.

Film 15

Film 15 was coated in the same way as film 12, the only difference being the admixture of emulsion A and emulsion B, in an amount corresponding to 27% by weight of the total amount of silver halide, expressed as silver nitrate for emulsion A and 73% for emulsion B.

Sensitometric results that were obtained after exposure and processing according to the procedures described for Film 11 are listed in Table I for freshly prepared materials and for materials that have been stored for 36 hours at 57° C. and 34% RH (relative humidity). The values given for the speed S in Table I are relative speed values with respect to reference film 11, the speed of which was given a value of 100. Fog F includes the density of the blue support.

TABLE I

| Film | Emulsion | 8 minutes cycle | | | | 2.5 minutes cycle | | | |
|---|---|---|---|---|---|---|---|---|---|
| | | Fresh | | Stored | | Fresh | | Stored | |
| ($AgNO_3$ wt. ratio A/B) | | F | S | F | S | F | S | F | S |
| 11 | 100/0 | 0.143 | 100 | 0.155 | 98 | 0.175 | 100 | 0.201 | 100 |
| 12 | 90/10 | 0.142 | 105 | 0.147 | 105 | 0.163 | 98 | 0.174 | 100 |
| 13 | 75/25 | 0.139 | 107 | 0.146 | 110 | 0.156 | 100 | 0.159 | 100 |
| 14 | 50/50 | 0.138 | 110 | 0.143 | 115 | 0.145 | 98 | 0.145 | 100 |
| 15 | 27/73 | 0.136 | 115 | 0.137 | 120 | 0.140 | 91 | 0.140 | 96 |

The results in Table I clearly illustrate the importance of the silver iodobromide emulsion to lower the fog level, especially in the 2.5 minutes processing cycle.

EXAMPLE 2

As Emulsion A and Emulsion B the same emulsions are taken as in Example 1.

Film 21 was the same as film 11 in Example 1.

Film 22

The emulsions A and B were coated in two adjacent layers at both sides of a substrated blue polyester undercoat, being 175 μm thick, making use of the slide hopper technique, the emulsion layers containing silver halide, expressed as $AgNO_3$, in an amount of 5.25 g/m$^2$ and gelatin in an amount of 2.62 g/m$^2$, for both emulsions A and B, the layer in which emulsion B was coated being situated farther from the support. Before coating stabilizers as 5-methyl-7-hydroxy-5-triazolo-[1,5-e]-pyrimidin and 1-phenyl-5-mercaptotetrazole were added to the emulsion B. To the emulsion A the same stabilizers were added as in film 11 of example 1. Emulsion layers containing emulsion B at both sides of the support were covered with a protective layer of 1.4 grams of gelatin per square meter, which were hardened with 0.134 g of di-(vinyl-sulphonyl)-methane per square meter.

Film 23

This film had the same layer arrangement as Film 22, except for the coated amount of gelatin and silver halide, expressed as $AgNO_3$, which was 7.85 g/m$^2$ of silver nitrate and 3.92 g/m$^2$ of gelatin for emulsion A; 2.4 g/m$^2$ of silver nitrate and 1.2 g/m$^2$ of gelatin for emulsion B.

Film 24

This film had the same composition as Film 12.

The sensitometric results obtained after exposure and processing according to the procedures described for Film 11 are listed in Table II.

TABLE II

| Film | Emulsion A/B | 8 minutes cycle | | | | 2.5 minutes cycle | | | |
|---|---|---|---|---|---|---|---|---|---|
| | | Fresh | | Stored | | Fresh | | Stored | |
| ($AgNO_3$ wt. ratio) | | F | S | F | S | F | S | F | S |
| 21 | 100/0 | 0.146 | 100 | 0.155 | 100 | 0.160 | 100 | 0.178 | 100 |
| 22 | | 0.141 | 110 | 0.143 | 115 | 0.146 | 93 | 0.158 | 95 |
| 23 | | 0.141 | 98 | 0.146 | 102 | 0.146 | 87 | 0.152 | 89 |
| 24 | 90/10 | 0.144 | 102 | 0.150 | 105 | 0.153 | 91 | 0.157 | 93 |

The results in Table II are illustrative for the improved fog level obtained by making use of a layer arrangement with two adjacent layers, one layer comprising a silver chloride rich emulsion, the layer farthest from the support comprising the silver iodobromide emulsion. The fog level is substantially better than is the case for film 21 comprising a silver chloride rich emulsion.

EXAMPLE 3

Emulsion C

A gelatino silver chloride emulsion comprising 99.6 mole % of chloride and 0.4 mole % of iodide was prepared by a double-jet technique as for emulsion A. The average grain size now was 0.57 μm as obtained by a reduction of the flow rate of the aqueous solutions of silver nitrate and of chloride. At the end of the precipitation step, coagulation, washing, peptising and chemical ripening were analogous to that described for emulsion A. Amounts of chemical ripening agents were adopted to the crystal size. The ratio by weight of the amount of gelatin to silver halide, expressed as silver nitrate, was 0.5.

Emulsion D

A gelatino silver iodobromide X-ray emulsion comprising 99 mole % of silver bromide and 1 mole % of silver iodide was prepared in the the same way as emulsion B, except for the presence of 3 grams of ammonia in the reaction vessel instead of methionin. In this way homogeneous and regular silver halide grains having a crystal diameter of 0.54 μm were obtained. The ratio by weight of the amount of gelatin to silver halide, expressed as silver nitrate, was 0.5.

Film 31 is the same as film 11 in Example 1 but Emulsion A is replaced by Emulsion C.

Films 32, 33 and 34 have the same composition as Films 12, 13 and 14 respectively except for the presence of emulsion C instead of emulsion A and of emulsion D instead of emulsion B.

The sensitometric results obtained after exposure and processing according to the procedures described for Film 11 are listed in Table III.

TABLE III

| Film | Emulsion C/D | 8 minutes cycle | | | | 2.5 minutes cycle | | | |
|---|---|---|---|---|---|---|---|---|---|
| | | Fresh | | Stored | | Fresh | | Stored | |
| | ($AgNO_3$ ratio) | F | S | F | S | F | S | F | S |
| 31 | 100/0 | 0.156 | 100 | 0.201 | 98 | 0.175 | 100 | 0.202 | 107 |
| 32 | 90/10 | 0.154 | 95 | 0.163 | 93 | 0.167 | 93 | 0.173 | 105 |
| 33 | 75/25 | 0.157 | 102 | 0.162 | 102 | 0.164 | 98 | 0.167 | 107 |
| 34 | 50/50 | 0.164 | 115 | 0.169 | 112 | 0.164 | 100 | 0.167 | 107 |

The results in Table III clearly illustrate the reduction of fog, especially upon storage, by the presence of the silver bromoiodide emulsion in the emulsion layer comprising the silver chloride emulsion crystals.

EXAMPLE 4

Emulsion E

A gelatino silver iodobromide X-ray emulsion comprising 99 mole % of silver bromide and 1 mole % of silver iodide was prepared in the the same way as emulsion D, except for the presence of 2.2 grams of ammonia in the reaction vessel instead of 3 grams. In this way homogeneous and regular silver halide grains having a crystal diameter of 0.47 μm were obtained. The ratio by weight of the amount of gelatin to silver halide, expressed as silver nitrate was 0.5.

Film 41 was the same film as Film 11

Film 42 was the same film as Film 12

Film 43 was coated with a mixture of Emulsion A and Emulsion E in a ratio by weight, expressed as the equivalent amounts of $AgNO_3$, of 90/10. Per square meter and per side an amount of silver halide corresponding to 10.5 g of silver nitrate and 5.25 g of gelatin were present.

Film 44 was coated with a mixture of Emulsion A and Emulsion D in a ratio of 90/10. Per square meter and per side an amount of silver halide corresponding to 10.5 g of silver nitrate and 5.25 g of gelatin were present.

Sensitometric results after exposure and processing according to the procedures described for Film 11 are listed in Table IV.

TABLE IV

| Film | Emulsion | 8 minutes cycle | | | | 2.5 minutes cycle | | | |
|---|---|---|---|---|---|---|---|---|---|
| | | Fresh | | Stored | | Fresh | | Stored | |
| | ($AgNO_3$ wt. ratio) | F | S | F | S | F | S | F | S |
| 41 | A/B = 100/0 | 0.146 | 100 | 0.160 | 100 | 0.171 | 100 | 0.191 | 98 |
| 42 | A/B = 90/10 | 0.144 | 102 | 0.147 | 110 | 0.165 | 102 | 0.176 | 102 |
| 43 | A/E = 90/10 | 0.143 | 95 | 0.152 | 105 | 0.164 | 95 | 0.173 | 98 |
| 44 | A/D = 90/10 | 0.145 | 102 | 0.155 | 105 | 0.162 | 102 | 0.167 | 105 |

The results in Table IV confirm the reduction of fog, especially upon storage, by the presence of the silver bromoiodide emulsion in the emulsion layer comprising the silver chloride emulsion crystals. In short processing cycles (2.5 minutes) the effect is still more pronounced than in longer processing cycles (8 minutes).

We claim:

1. A photographic silver halide material for industrial radiography comprising a film support and on one or both sides thereof at least one emulsion layer containing non-spectrally, chemically sensitized silver chloride and at least one non-sensitive protective antistress coating characterised in that said at least one emulsion layer containing silver chloride further comprises at least one non-spectrally, chemically sensitized silver bromide and/or silver bromoiodide emulsion mixed with the said emulsion(s) containing chloride and/or has contiguous thereto at least one adjacent layer comprising silver bromide and/or bromoiodide emulsion crystals, the total amount by weight of the non-chloride containing emulsions, expressed as silver nitrate, corresponding to less than 75% of the totally coated amount of silver halide and in that the total ratio by weight of colloidal binder to silver halide (expressed as silver nitrate) of the silver halide emulsion layer(s) is from 3:10 to 6:10, the total amount of silver halide corresponds to from 6 g to 20 g of silver nitrate per square meter and per side and that the material has been forehardened to an extent such that when it is immersed in demineralised water of 25° C. for 3 minutes there is absorbed less than 2.5 g of water per gram of colloid binder.

2. A photographic material according to claim 1 wherein said material is a duplitized radiographic material having silver halide emulsion layers on both sides of the support.

3. A photographic material according to claim 1 wherein at least one of the silver halide emulsion crystals is composed of crystals having a cubic crystal habit.

4. A photographic material according to claim 1 wherein said silver brom(oiod)ide emulsion crystals have a crystal diameter of 0.15 to 1.00 μm.

5. A photographic material according to claim 1 wherein the silver bromoiodide emulsion(s) has (have) an iodide content of up to 2 mole %.

6. A photographic material according to claim 1 wherein the emulsion(s) rich in chloride contain chloride ions in an amount of at least 90 mole %.

7. A photographic material according to claim 1 wherein the binder has been hardened with di-(vinylsulphonyl)-methane or ethylene di-(vinyl-sulphone).

* * * * *